US009303644B2

(12) United States Patent
Czerwonka

(10) Patent No.: US 9,303,644 B2
(45) Date of Patent: Apr. 5, 2016

(54) GEAR PUMP BEARING DAM

(71) Applicant: Woodward, Inc., Fort Collins, CO (US)

(72) Inventor: Adam F. Czerwonka, Roscoe, IL (US)

(73) Assignee: Woodward, Inc., Fort Collins, CO (US)

( * ) Notice: Subject to any disclaimer, the term of this patent is extended or adjusted under 35 U.S.C. 154(b) by 61 days.

(21) Appl. No.: 14/090,786

(22) Filed: Nov. 26, 2013

(65) Prior Publication Data

US 2015/0147211 A1 May 28, 2015

(51) Int. Cl.

| | |
|---|---|
| ***F01C 21/00*** | (2006.01) |
| ***F03C 2/00*** | (2006.01) |
| ***F03C 4/00*** | (2006.01) |
| ***F04C 18/10*** | (2006.01) |
| ***F04C 2/08*** | (2006.01) |
| ***F04C 18/08*** | (2006.01) |
| ***F04C 2/18*** | (2006.01) |

(52) U.S. Cl.

CPC ..... *F04C 18/10* (2013.01); *F04C 2/084* (2013.01); *F04C 2/086* (2013.01); *F04C 2/088* (2013.01); *F04C 2/18* (2013.01); *F04C 18/084* (2013.01); *F04C 18/088* (2013.01); *F04C 2240/56* (2013.01)

(58) Field of Classification Search

CPC ..... F04C 2/08; F04C 2/084; F04C 2/086; F04C 2/088; F04C 2/18; F04C 15/0049; F04C 18/084

USPC ..... 418/189–190, 206.1–206.8

See application file for complete search history.

(56) References Cited

U.S. PATENT DOCUMENTS

| | | | | |
|---|---|---|---|---|
| 2,781,730 | A | 2/1957 | Newmier | |
| 4,017,224 | A | 4/1977 | Jons | |
| 4,097,206 | A | 6/1978 | Schonherr | |
| 4,290,739 | A | 9/1981 | Korse | |
| 5,131,829 | A * | 7/1992 | Hampton | F04C 28/0035 418/189 |
| 6,042,352 | A | 3/2000 | Halter et al. | |
| 6,716,010 | B2 * | 4/2004 | Eaton et al. | 418/206.8 |
| 7,878,781 | B2 * | 2/2011 | Elder | 418/189 |
| 7,922,468 | B2 | 4/2011 | Chang | |
| 2008/0166254 | A1 | 7/2008 | Jordan et al. | |
| 2012/0219449 | A1 | 8/2012 | Ni et al. | |

FOREIGN PATENT DOCUMENTS

| | | |
|---|---|---|
| EP | 2071122 | 6/2009 |
| GB | 1575328 | 9/1980 |
| JP | 4726324 | 7/2011 |

OTHER PUBLICATIONS

Authorized Officer Pierre Descoubes, PCT International Search Report and Written Opinion of the International Searching Authority, PCT/US2014/038331, Aug. 4, 2014, 11 pages.

* cited by examiner

*Primary Examiner* — Theresa Trieu
(74) *Attorney, Agent, or Firm* — Fish & Richardson P.C.

(57) ABSTRACT

The subject matter of this specification can be embodied in, among other things, a method that includes a gear pump includes gears having a gear root diameter and teeth having an addendum and pressure angle. A housing includes a fluid inlet and discharge, bearings configured to position the gear teeth in intermeshing contact across a fluid dam. The fluid dam includes a first face arranged at an angle to a split line, spaced apart from a center line at the split line a first distance towards the inlet, and extending from the first gear root diameter away from the center line to the first gear root diameter, and a second face arranged approximately perpendicular to the split line, spaced apart from the center line at the split line a second distance towards the outlet, and extending between the first gear root diameter and the second gear root diameter.

20 Claims, 5 Drawing Sheets

GEAR PUMP BEARING DAM

TECHNICAL FIELD

This invention relates to a gear pump, and more particularly to a fluid gear pump that includes a central fluid dam formed to reduce cavitation of the fluid being pumped.

BACKGROUND

Gear pumps use meshed gears to pump fluid by displacement. Gear pumps exhibit positive or fixed displacement performance, meaning they pump a predetermined amount of fluid for each revolution. As the gears rotate they separate on an intake side of the pump, creating a void that is filled by the fluid being pumped. The fluid is carried in the spaces between the gear teeth about the outer peripheries of the gears to a discharge side of the pump. As the gears mesh, the fluid is displaced and flows out the discharge side of the pump. The intermeshing of the gears, along with the speed of rotation of the gears, effectively prevents leakage and backflow of the fluid being pumped.

Cavitation is a term that is used to describe a phenomenon in which bubbles or "vapor cavities" can form in a fluid due to forces acting upon the fluid. Cavitation can be caused by rapidly dropping the pressure of a fluid. When subjected to higher pressure, the bubbles can implode, generating intense shockwaves. These shockwaves can cause wear in some mechanical devices. Vapor cavities that implode near solid surfaces can cause cyclic stresses through repeated exposure to such implosions. Repeated exposure can lead to surface fatigue of the solid surface and can cause a type of wear also referred to as "cavitation". This type of wear can occur upon solid surfaces such as pump impellers, generally at locations where sudden changes in the pressures of liquids occur.

SUMMARY

In general, this document describes a fluid gear pump that includes a central fluid dam formed to reduce cavitation of the fluid being pumped.

In a first aspect, a gear pump includes a first gear having a first axis, a first gear root diameter, and a plurality of first gear teeth having a gear addendum and a gear set pressure angle. The gear pump also includes a second gear having a second axis, a second gear root diameter, and a plurality of second gear teeth having the gear addendum and the gear set pressure angle. A housing includes a fluid inlet and a fluid discharge, a first gear bearing and a second gear bearing configured to position the first gear and the second gear along a bearing center line extending between the first axis and the second axis on opposite sides of a bearing split line, the bearing split line extending through a midpoint between the first gear root diameter and the second gear root diameter and extending perpendicular to the bearing center line, the first gear bearing and the second gear bearing configured to position the first gear teeth and second gear teeth in intermeshing contact, and a central fluid dam. The central fluid dam includes a first face arranged at an angle to the bearing split line, spaced apart from the bearing center line at the bearing split line a first distance towards the fluid inlet, and extending from the first gear root diameter away from the bearing center line to the second gear root diameter, and a second face arranged approximately perpendicular to the bearing split line, spaced apart from the bearing center line at the bearing split line a second distance towards the fluid outlet, and extending between the first gear root diameter and the second gear root diameter.

Various embodiments can include some, all, or none of the following features. The first distance can be in a range of about 35% to about 65% of a gear addendum away from the bearing center line towards the fluid inlet at the bearing split line. The first distance can be about 47% of the gear addendum. The angle to the center line can range from about the angle of the gear set pressure angle plus 5 degrees to about the angle of the gear set pressure angle minus 5 degrees. The angle to the center line can be about 25 degrees. The central fluid dam can also include a slot formed in the first face proximate the first gear, the slot extending approximately tangent to the first gear root diameter toward the fluid discharge, the slot having a slot width in the range of about 15% to about 44.6% of the gear addendum, and the slot having a slot depth in the range of about 15% to about 45% of a gear addendum. The slot depth can be about 33% of the gear addendum and the slot width can be about 25.3% of the gear addendum. The second distance can be in a range of about 90% to about 115% of a gear addendum away from the bearing center line towards the fluid discharge at the bearing split line. The second distance can be about 103.21% of the gear addendum. The central fluid dam can also include a vent formed in the second face proximate the second gear, the vent having a semi-circular cross-section extending into the second face, the vent having a radius approximately tangent to the second gear root diameter, and the vent being spaced apart from the bearing center line toward the fluid discharge a third distance in a range of about 50% to about 75% of a gear addendum. The third distance can be about 63% of the gear addendum.

In a second aspect, a method for pumping a fluid includes providing a gear pump having a first gear having a first axis, a first gear root diameter, and a plurality of first gear teeth having a gear addendum and a gear set pressure angle, a second gear having a second axis, a second gear root diameter, and a plurality of second gear teeth having the gear addendum and the gear set pressure angle. The method also includes providing a housing having a fluid inlet and a fluid discharge, a first gear bearing and a second gear bearing configured to position the first gear and the second gear along a bearing center line extending between the first axis and the second axis on opposite sides of a bearing split line, the bearing split line extending through a midpoint between the first gear root diameter and the second gear root diameter and extending perpendicular to the bearing center line, the first gear bearing and the second gear bearing configured to position the first gear teeth and second gear teeth in intermeshing contact, and a central fluid dam. The central fluid dam includes a first face arranged at an angle to the bearing split line, spaced apart from the bearing center line at the bearing split line a first distance towards the fluid inlet, and extending from the first gear root diameter away from the bearing center line to the second gear root diameter, and a second face arranged approximately perpendicular to the bearing split line, spaced apart from the bearing center line at the bearing split line a second distance towards the fluid outlet, and extending between the first gear root diameter and the second gear root diameter. The method also includes providing the fluid at the fluid inlet to a collection of tooth spaces, driving the first gear, driving the second gear with the first gear, and urging the movement of the fluid in the collection of tooth spaces from the fluid inlet to the fluid discharge, wherein backflow of the fluid from the fluid discharge to the fluid inlet is impeded by the central fluid dam.

Various implementations can include some, all, or none of the following features. The first distance can be in a range of about 35% to about 65% of a gear addendum away from the bearing center line towards the fluid inlet at the bearing split line. The first distance can be about 47% of the gear addendum. The angle to the center line can range from about the angle of the gear set pressure angle plus 5 degrees to about the angle of the gear set pressure angle minus 5 degrees. The angle to the center line can be about 25 degrees. The central fluid dam can also include a slot formed in the first face proximate the first gear, the slot extending approximately tangent to the first gear root diameter toward the fluid discharge, the slot having a slot width in the range of about 15% to about 44.6% of the gear addendum, and the slot having a slot depth in the range of about 15% to about 45% of a gear addendum. The slot depth can be about 33% of the gear addendum and the slot width can be about 25.3% of the gear addendum. The second distance can be in a range of about 90% to about 115% of a gear addendum away from the bearing center line towards the fluid discharge at the bearing split line. The second distance can be about 103.21% of the gear addendum. The central fluid dam can also include a vent formed in the second face proximate the second gear, the vent having a semi-circular cross-section extending into the second face, the vent having a radius approximately tangent to the second gear root diameter, and the vent being spaced apart from the bearing center line toward the fluid discharge a third distance in a range of about 50% to about 75% of a gear addendum. The third distance can be about 63% of the gear addendum. The systems and techniques described herein may provide one or more of the following advantages. First, cavitation of the fluid being pumped can be reduced. Second, erosion of pump components due to fluid cavitation can be reduced. Third, maintenance costs for the pump can be reduced. Fourth, the service life of the pump may be improved. Fifth, the pumping inefficiencies due to erosion of pump components may be reduced.

The details of one or more implementations are set forth in the accompanying drawings and the description below. Other features and advantages will be apparent from the description and drawings, and from the claims.

DETAILED DESCRIPTION

This invention relates to a gear pump, and more particularly to a fluid gear pump that includes a central fluid dam formed to reduce cavitation of the fluid being pumped. In general, cavitation can accelerate the wear and reduce the pumping efficiency and lifespan of gear pump components, particularly gear teeth. By reducing cavitation, such wear can be reduced, and the efficiency and lifespan of the pump can be increased.

Gear pump bearings can have inlet and discharge relief cuts in the face of the floating and stationary bearings. Such relief cuts can allow the fluid being pumped to flow out of the gear mesh to the top and bottom of the gear on the discharge side and flow into the gear mesh from the top and bottom of the gear on the inlet side. Such relief cuts leave some of the bearing material near the center line between the inlet and discharge to create a bearing dam. The bearing dam substantially seals the inlet from the discharge side to maintain pumping efficiency. In some embodiments, the shape of the bearing dam can have a significant impact on gear venting and filling, and therefore may impact the cavitation performance of the gear pump.

Still speaking generally, the gear pump described in this specification includes a bearing dam with a geometry that reduces fluid cavitation and the damage that can result. The bearing dam geometry can be described using multiple methods to calculate the appropriate scale of the features for a given pump size. One such method is described herein to scale the geometry to a desired pump size by describing the features as a percentage of the gear addendum, which can also be referred to as the 'standard gear addendum', and be defined as 1/(gear pitch) for pump gears.

Figure 1:
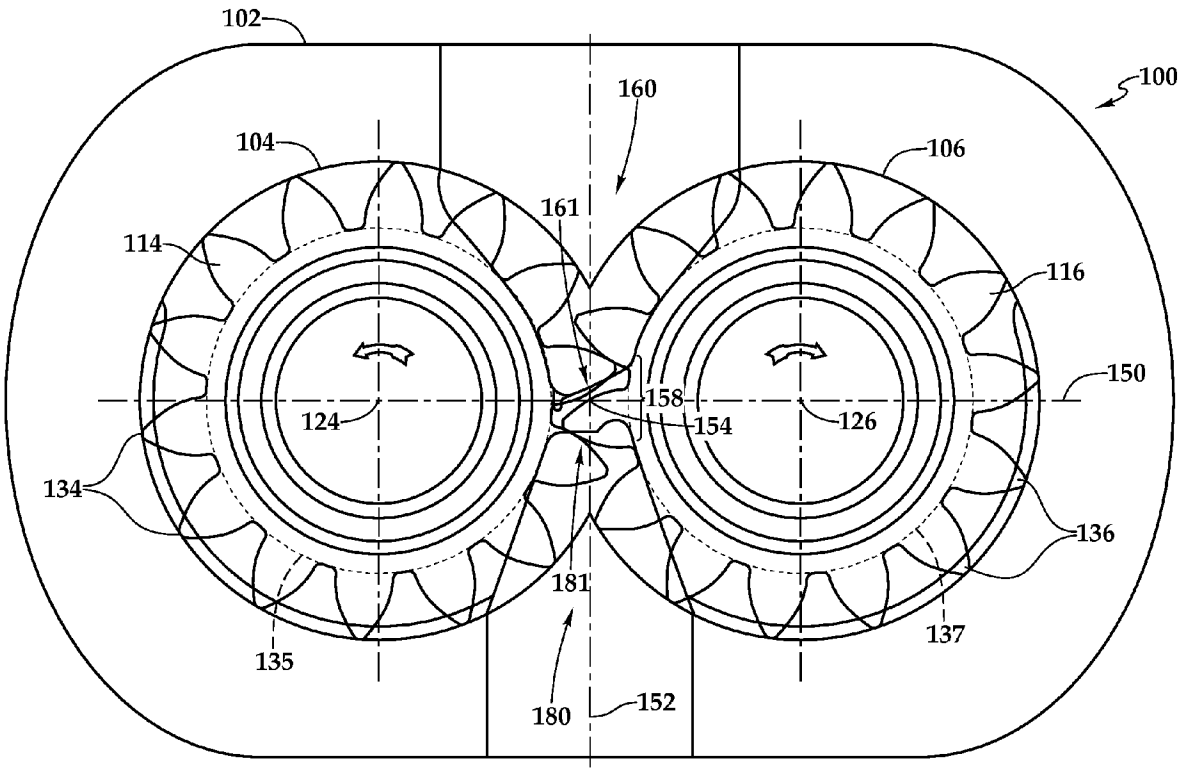
FIG. 1 is a cross-sectional view of an example gear pump assembly.

FIG. 1 is a cross-sectional view of an example gear pump assembly 100. The assembly 100 includes a housing 102. The housing 102 includes a driving gear bearing 104 and a driven gear bearing 106. The driving gear bearing 104 is configured to support a driving gear 114 rotationally at a driving gear axis 124. The driven gear bearing 106 is configured to support a driven gear 116 rotationally at a driven gear axis 126. The driving gear 114 includes a collection of driving gear teeth 134 extending radially outward from a root diameter 135. The driven gear 116 includes a collection of driven gear teeth 136 extending radially outward from a root diameter 137.

A bearing center line 150 extends through both the driving gear axis 124 and the driven gear axis 126. The gear bearings 104, 106 are configured such that the driving gear teeth 134 and the driven gear teeth 136 intermesh along the bearing center line 150. A bearing split line 152 extends perpendicular to the bearing center line 150 through a center point 154 substantially centered between the root diameters 135 and 137 along the bearing center line 150.

The housing 102 includes a fluid inlet cavity 160 and a fluid discharge cavity 180. In some embodiments, the fluid inlet cavity 160 and/or the fluid discharge cavity 180 may be formed as relief cuts in faces of the housing 102 and/or the gear bearings 104, 106. In some embodiments, the fluid inlet cavity 160 and/or the fluid outlet cavity 180 may be molded, cast, etched, or otherwise formed within the housing 102. The fluid inlet cavity 160 is in fluid communication with a fluid inlet (not shown), and the fluid discharge cavity 180 is in fluid communication with a fluid outlet (not shown).

The fluid inlet cavity 160 includes a bearing dam inlet face 161, and the fluid outlet cavity 180 includes a bearing dam outlet face 181. The bearing dam inlet face 161 and the bearing dam outlet face 181 extend across the bearing split line 161 generally along the bearing center line 160 to form a central fluid dam 158. In general, the assembly 100 is configured such that fluid pressure within the fluid inlet cavity 160, coupled with predetermined geometry of the central fluid dam 158, ports fluid flow to the intermeshed collections of gear teeth 134, 136 at predetermined timing to reduce the level of cavitation induced in the fluid being pumped. The aforementioned geometry of the central fluid dam 158 is discussed further in the descriptions of FIGS. 4-6.

FIGS. 2A-2D show exploded perspective views of the example gear pump assembly 100. The housing 102 is removed in FIGS. 2A-2D to better illustrate the remaining internal components of the assembly 100.

Figure 2A:
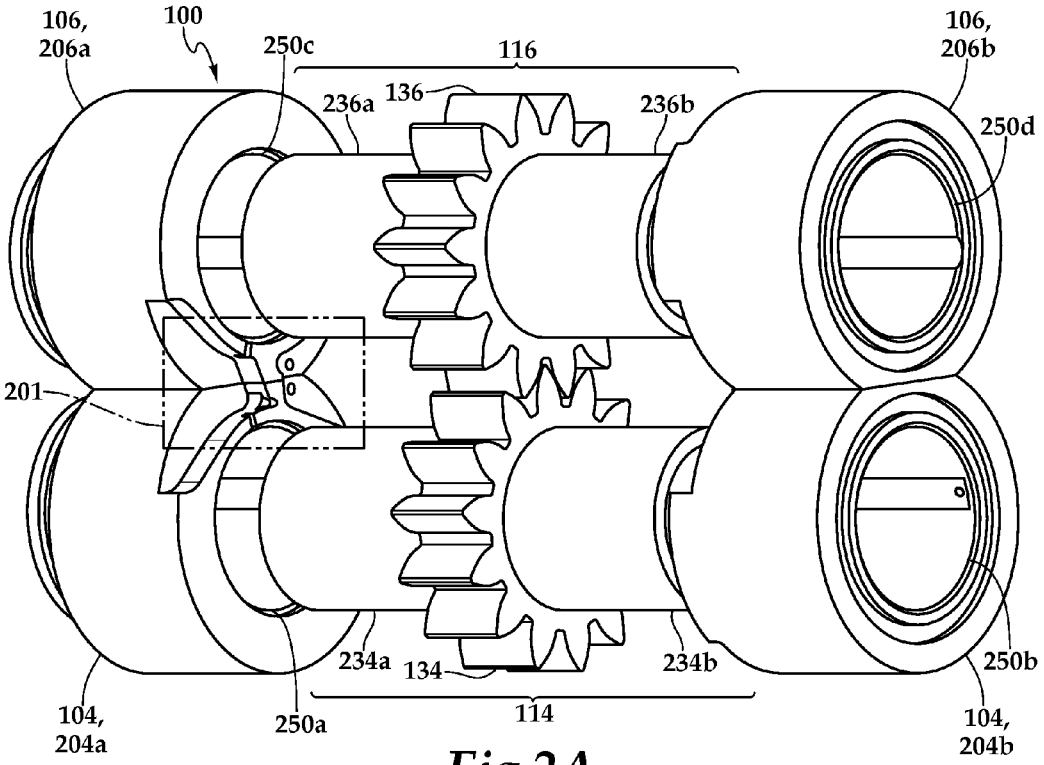
FIGS. 2A-2D are perspective views of the example gear pump assembly.
Figure 2B:
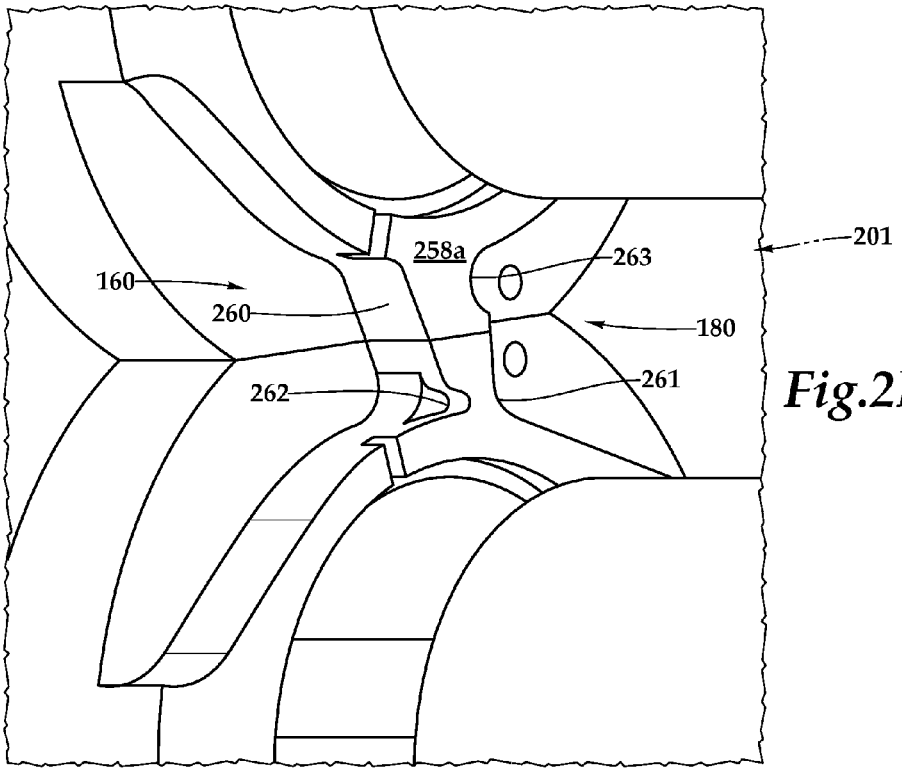
Figure 2C:
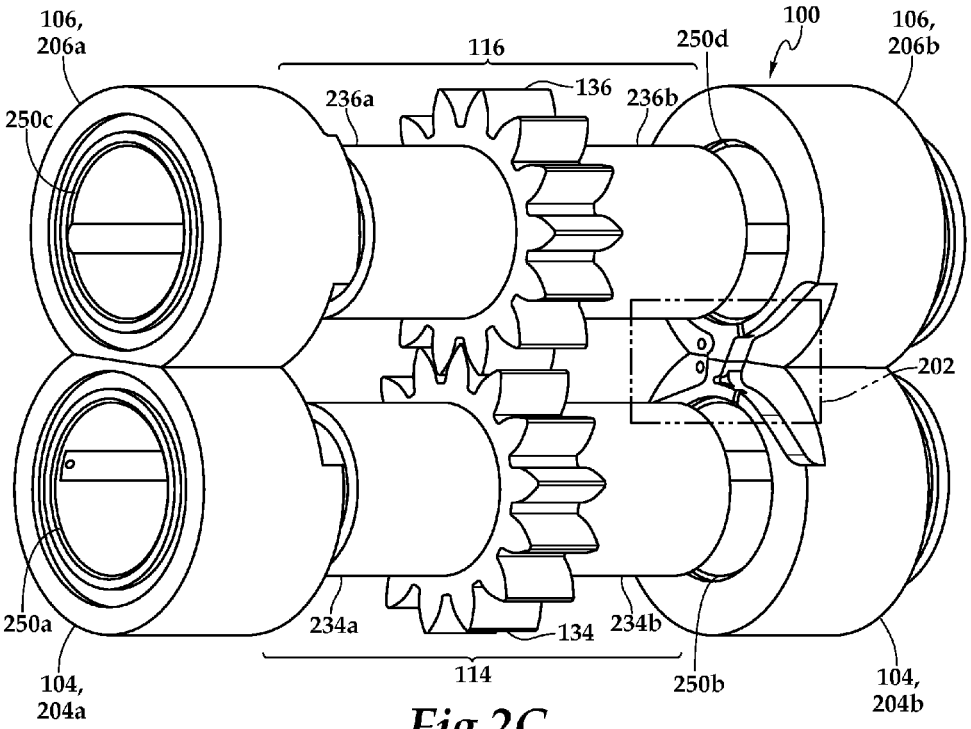

FIGS. 2A and 2C show front and back offset angle perspective views, respectively, of the assembly 100. As shown in FIG. 2A, the driving gear bearing 104 of FIG. 1 includes a driving gear bearing half 204*a* and a driving gear bearing half 204*b*. The driving gear 114 includes the driving gear teeth 134, a central shaft portion 234*a* (e.g., a journal) extending axially from the driving gear teeth 134, and a central shaft portion 234*b* extending axially from the driving gear teeth 134 opposite the central shaft portion 234*a*. The driving gear bearing half 204*a* includes a bore 250*a*, and the driving gear bearing half 204*b* includes a bore 250*b*. The bore 250*a* is formed to accept insertion of and rotationally support the central shaft portion 234*a*, and the bore 250*b* is formed to accept insertion of and rotationally support the central shaft portion 234*b*, when the assembly 100 is in its assembled form.

As shown in FIG. 2A, the driven gear bearing 106 of FIG. 1 includes a driven gear bearing half 206*a* and a driven gear bearing half 206*b*. The driven gear 116 includes the driven gear teeth 136, a central shaft portion 236*a* extending axially from the driven gear teeth 136, and a central shaft portion 236*b* extending axially from the driven gear teeth 136 opposite the central shaft portion 236*a*. The driven gear bearing half 206*a* includes a bore 250*c*, and the driven gear bearing half 206*b* includes a bore 250*d*. The bore 250*c* is formed to accept insertion of and rotationally support the central shaft portion 236*a*, and the bore 250*d* is formed to accept insertion of and rotationally support the central shaft portion 236*b*, when the assembly 100 is in its assembled form.

Figure 2D:
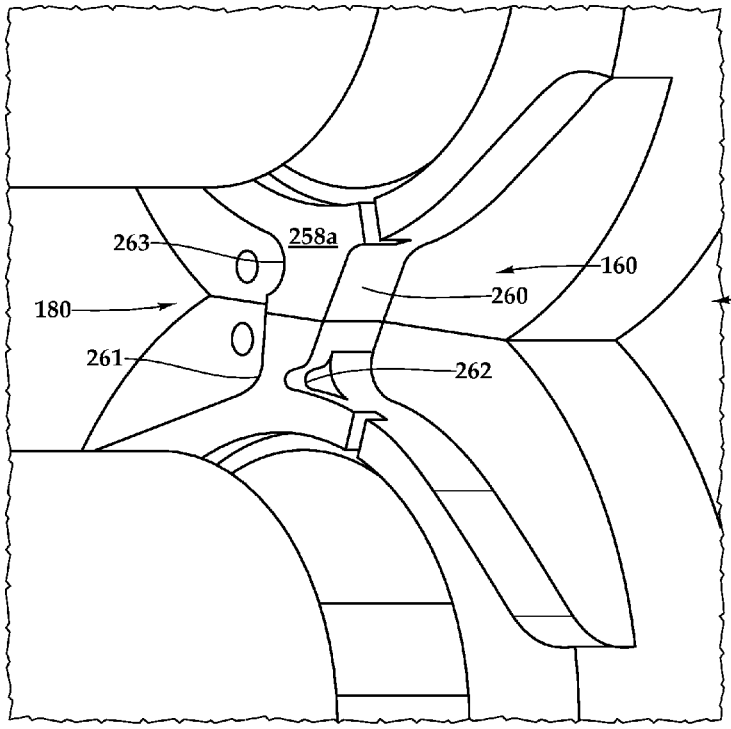

The assembly 100 includes the central fluid dam 158 within the areas generally indicated as area 201 in FIG. 2A and area 202 in FIG. 2C. FIG. 2B is an enlarged view of the bearing dam shown in area 201, and FIG. 2D is an enlarged view of the bearing dam shown in area 202. The central fluid dam 158 includes a central fluid dam half 258*a* that will be described with respect to FIG. 2B, and a central fluid dam half 258*b* that will be described with respect to FIG. 2D.

Referring now to FIGS. 2B and 2D, the central fluid dam halves 258*a* and 258*b* of the central fluid dam 158 includes an inlet face 260 and an outlet face 261. The inlet face includes a slot 262 formed as a relief cut in the inlet face 260. The outlet face 261 includes a vent 263 formed as a relief cut in the outlet face 261. In the assembled form of assembly 100, the central fluid dam halves 258*a* and 258*b*, the driving gear teeth 134, and the driven gear teeth 136 provide a barrier that substantially blocks the flow of fluid between the fluid inlet cavity 160 and the fluid discharge cavity 180 along the bearing split line 152 across the bearing center line 150. The configuration of the inlet face 260, the outlet face 261, the slot 262, and the vent 263 will be discussed further in the descriptions of FIGS. 4-6.

Figure 3:
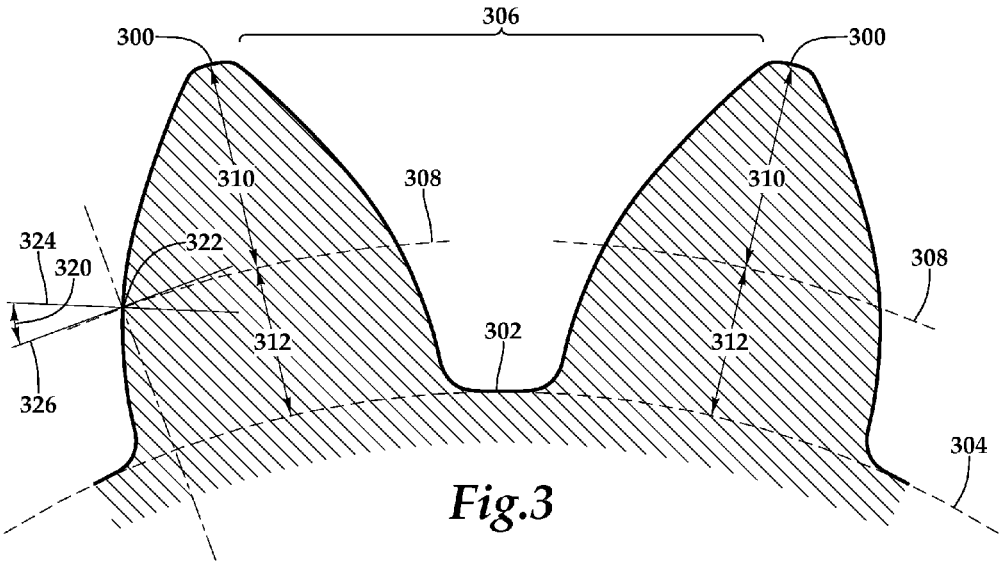
FIG. 3 is a side view of a collection of example gear teeth of the example gear pump assembly.

FIG. 3 is a side view of a collection of example gear teeth 300. In some embodiments, the gear teeth 300 can represent the driving gear teeth 134 and/or the driven gear teeth 136 of the example gear pump assembly 100.

The gear teeth 300 extend radially from a gear 302. In some embodiments, the gear 302 can be the driving gear 114 or the driven gear 116. The gear 302 has a root diameter 304, which is the diameter at the base of a tooth space 306. In some embodiments, the root diameter 304 can be the root diameter 135 or the root diameter 136. The gear 302 also includes a pitch circle 308. In some embodiments, the pitch circle 308 can be the circle derived from the number of the gear teeth 300 and a predetermined diametral or circular pitch, and can be the circle on which spacing or tooth profiles is established and from which the tooth proportions can be constructed.

Each of the gear teeth 300 includes an addendum 310 and a dedendum 312. The addendum 310 is the height by which the gear tooth 300 projects beyond the pitch circle 308, while the dedendum 312 is the depth of the tooth space 306 between the pitch circle 308 and the root diameter 304. As will be discussed in the descriptions of FIGS. 4-6, the geometry of the central fluid dam 158 can be partly based on the addendum 310.

Each of the gear teeth 300 also includes a pressure angle 320. The pressure angle 320 is the angle at a pitch point 322 on the pitch circle 308 between the line of pressure which is normal to the tooth surface at pitch point 322, and the plane tangent to the pitch circle 308. In involute teeth such as the gear teeth 300, the pressure angle 320 can be also described as the angle between a line of action 324 and a line 326 tangent to the pitch circle 308. In some implementations, standard pressure angles can be established in connection with standard gear-tooth proportions. As will be discussed in the descriptions of FIGS. 4-6, the geometry of the central fluid dam 158 can be partly based on the pressure angle 320.

Figure 4:
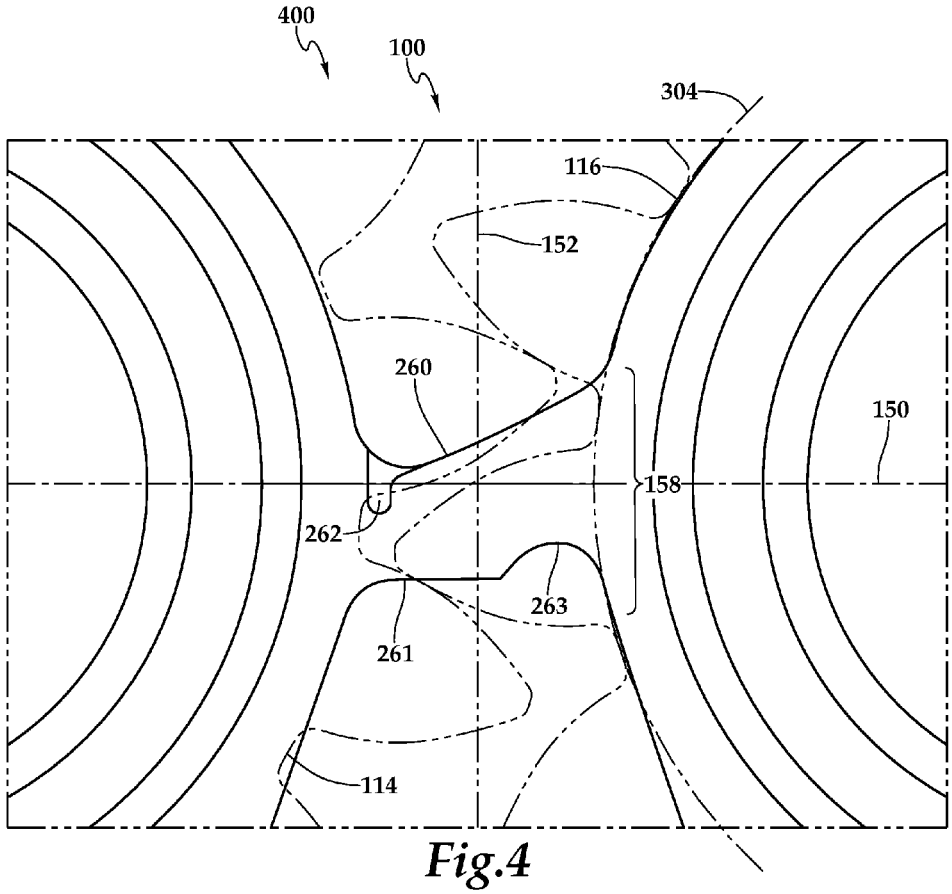
FIG. 4 is an enlarged cross-sectional view of the example gear pump assembly.

FIG. 4 is an enlarged cross-sectional view 400 of the example gear pump assembly 100 of FIG. 1. The view 400 shows the driving gear 114 and the driven gear 116, arranged along the bearing center line 150 and on opposite sides of the bearing split line 152. Visible between the driving gear 114 and the driven gear 116 is the central fluid dam 158, with the inlet face 260, the outlet face 261, the slot 262, and the vent 263.

Figure 5:
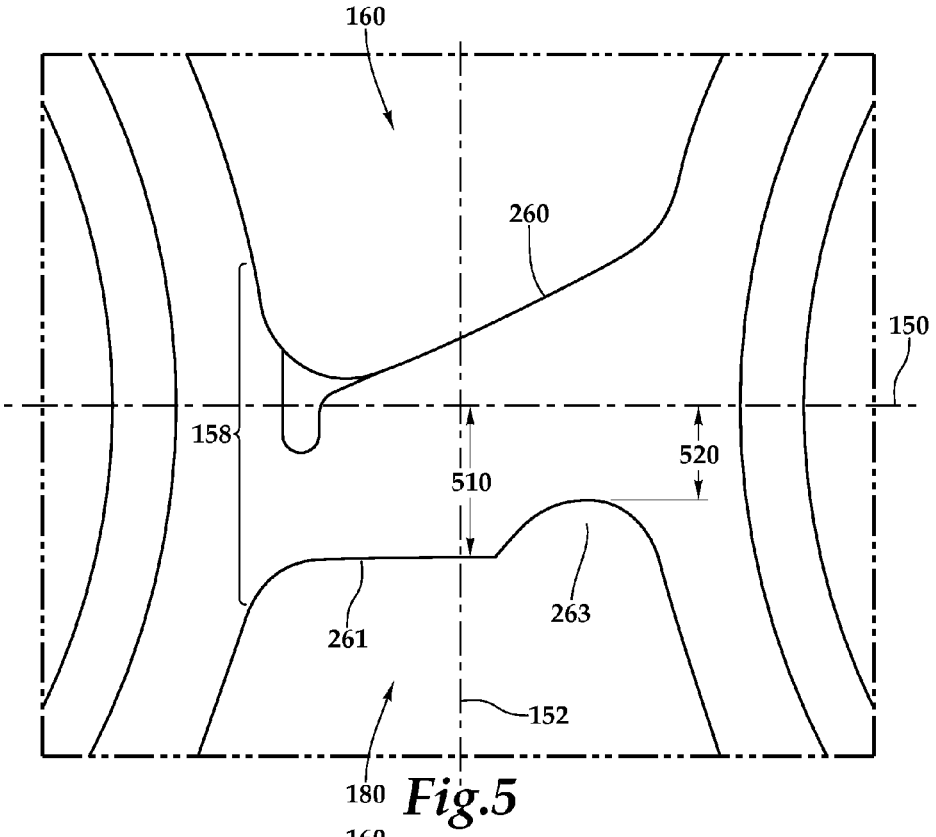
FIGS. 5 and 6 are enlarged cross-sectional views of a fluid dam of the example gear pump assembly.
Figure 6:
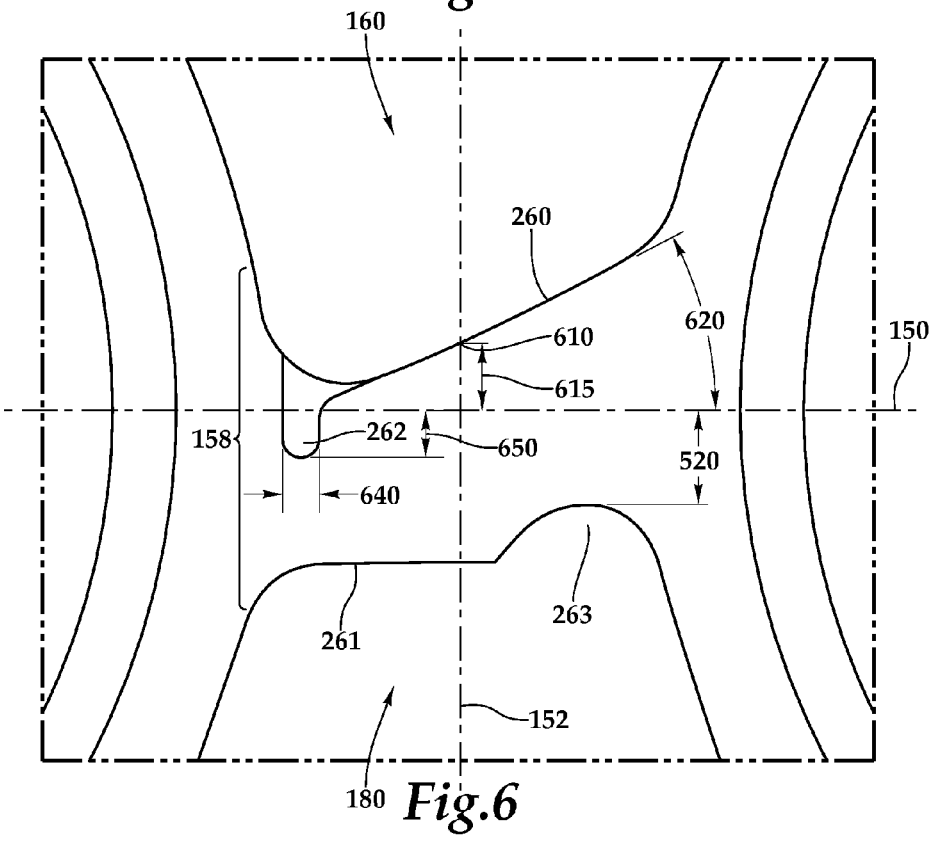

FIGS. 5 and 6 are enlarged cross-sectional views of a central portion of the central fluid dam 158 of the example gear pump assembly 100 of FIG. 100. Referring now to FIG. 5, the discharge side of the central fluid dam 158 includes the outlet face 261. The outlet face 261 is an edge that is substantially perpendicular to the bearing split line 152. The outlet face 261 is located a distance 510 into the fluid discharge cavity 180 from the bearing center line 150. In some embodiments, the distance 510 can be about 90% to about 115% of the gear addendum, e.g., the addendum 310 as shown in FIG. 3, into the fluid discharge cavity 180 away from the bearing center line 150. In one example, the addendum can be about 0.1744227 and the distance 510 from the bearing center line 150 to the outlet face 261 can be approximately 0.1800, or approximately 103.21% of the addendum (e.g., 0.1800=approximately 1.0321×an addendum of 0.1744227).

The vent 263 is formed in the discharge face 261 proximate the driven gear 116 (not shown in FIG. 5). The vent 263 has a generally semi-circular cross-section extending into the discharge face 261 toward the bearing center line 150. The vent 263 has a radius approximately tangent to the gear root diameter 137 of the driven gear 116 (not shown in FIG. 5), the radius being in a range of about 40% to about 85% of the gear addendum. For example, the addendum can be about 0.1744227 and the radius can be 0.0940 or approximately 54% of the gear addendum (e.g., 0.0940=approximately 0.54×an addendum of 0.1744227). As shown, the vent 263 is spaced apart from the bearing center line 150 toward the discharge face 261*a* distance 520 in a range of about 50% to about 75% of the gear addendum, e.g., the addendum 310 of FIG. 3. In some embodiments, the distance 520 can be about 63% of the gear addendum.

Referring now to FIG. 6, the fluid inlet cavity 160 side of the central fluid dam 158 includes the inlet face 260. The inlet face 260 is a substantially straight edge that intersects the bearing split line 152 at a point represented by a point 610. The point 610 is located a distance 615 of about 35% to about 65% of the gear addendum, e.g., the addendum 310 of FIG. 3, into the fluid inlet cavity 160 away from the bearing center line 150. For example, the distance 615 from the point 610 on the bearing split line 152 to bearing center line 150 can be 0.0816, or approximately 47% of gear addendum (e.g., 0.0816=approximately 0.47×an addendum of 0.1744227)

The inlet face 260 is angled into the fluid inlet cavity 160 away from the bearing center line 150 as it approaches the gear root diameter, e.g., the gear root diameter 304 of the driven gear 116 (not shown in FIG. 6), at a face angle 620 approximately equal to the gear set pressure angle, e.g., the pressure angle 320, +/− approximately 5 degrees. For example, the pressure angle 320 may be 28 degrees, and the face angle 620 can be about 25 degrees (e.g., pressure angle of 28 degrees−3 degrees=25 degrees).

The slot 262 is formed in the inlet face 260 proximate the driving gear 114 (not shown in FIG. 6). The slot 262 extends approximately tangent to the root diameter 135 of the driving gear 114 (not shown in FIG. 6) away from the fluid inlet cavity 160 and toward the fluid discharge cavity 180. The slot 262 has a slot width 640 in the range of about 15% to about 44.6% of the gear addendum, e.g., the gear root diameter 304, and the slot 261 has a slot depth 650 in the range of about 15% to about 45% of the gear addendum. In some embodiments, the slot depth 650 of the slot 261 can be about 33% of the gear addendum. In some embodiments, the slot width 640 of the slot can be about 25.3% of the gear addendum.

Figure 7:
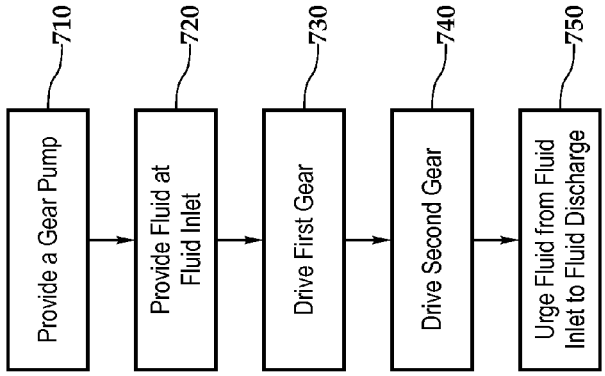
FIG. 7 is a flow diagram of an example process for pumping fluid with the example gear pump assembly.

FIG. 7 is a flow diagram of an example process 700 for pumping fluid with the example gear pump assembly 100 of FIG. 1. The process 700 begins when a gear pump is provided (710). In some implementations, the gear pump can be the gear pump assembly 100 of FIG. 1. Fluid is provided (720) at a fluid inlet to a collection of tooth spaces. For example, fluid can be provided at the fluid inlet to the fluid inlet cavity 160, where the fluid can flow into the tooth spaces 306 of FIG. 3.

The first gear is then driven (730). For example, the driving gear 114 can be spun by an external force. The second gear is driven (740) with the first gear. For example, the driving gear teeth 134 can be intermeshed with the driven gear teeth 136 to transfer motion of the driving gear 114 to the driven gear 116.

Movement of the fluid in the collection of tooth spaces is urged (750) from the fluid inlet to the fluid discharge. Backflow of the fluid from the fluid discharge to the fluid inlet is impeded by the central fluid dam. For example, as the driving gear 114 and the driven gear 116 rotate, fluid occupying the tooth spaces 306 between the gear teeth 134, 136, the gear roots 135, 137, and the housing 102, is urged from the fluid inlet cavity 160 to the fluid discharge cavity 180 and out the fluid discharge. Backflow of fluid from the fluid discharge cavity 180 to the fluid inlet cavity 160 is substantially blocked by the central fluid dam 158 and the intermeshed gear teeth 114, 116 across the bearing split line 152.

Although a few implementations have been described in detail above, other modifications are possible. For example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A gear pump comprising:

a first gear having a first axis, a first gear root diameter, and a plurality of first gear teeth having a gear addendum and a gear set pressure angle;

a second gear having a second axis, a second gear root diameter, and a plurality of second gear teeth having the gear addendum and the gear set pressure angle;

a housing comprising:

a fluid inlet and a fluid discharge;

a first gear bearing and a second gear bearing configured to position the first gear and the second gear along a bearing center line extending between the first axis and the second axis on opposite sides of a bearing split line, the bearing split line extending through a midpoint between the first gear root diameter and the second gear root diameter and extending perpendicular to the bearing center line, the first gear bearing and the second gear bearing configured to position the first gear teeth and second gear teeth in intermeshing contact; and, a central fluid dam comprising:

a first face arranged at an angle to the bearing split line, spaced apart from the bearing center line at the bearing split line a first distance towards the fluid inlet, formed as a straight edge intersecting the bearing split line and extending from the first gear root diameter away from the bearing center line to the second gear root diameter;

a second face arranged approximately perpendicular to the bearing split line, spaced apart from the bearing center line at the bearing split line a second distance towards the fluid outlet, and extending between the first gear root diameter and the second gear root diameter; and a vent formed in the second face proximate the second gear, the vent having a semi-circular cross-section extending into the second face, the vent having a radius approximately tangent to the second gear root diameter, and the vent being spaced apart from the bearing center line toward the fluid discharge a third distance in a range of about 50% to about 75% of a gear addendum.

2. The gear pump of claim 1, wherein the first distance is in a range of about 35% to about 65% of a gear addendum away from the bearing center line towards the fluid inlet at the bearing split line.

3. The gear pump of claim 2, wherein the first distance is about 47% of the gear addendum.

4. The gear pump of claim 1, wherein the angle to the bearing split line ranges from about the angle of the gear set pressure angle plus 5 degrees to about the angle of the gear set pressure angle minus 5 degrees.

5. The gear pump of claim 4, wherein the angle to the center line is about 25 degrees.

6. The gear pump of claim 1, wherein the central fluid dam further comprises a slot formed in the first face proximate the first gear, the slot extending approximately tangent to the first gear root diameter toward the fluid discharge, the slot having a slot width in the range of about 15% to about 44.6% of the gear addendum, and the slot having a slot depth in the range of about 15% to about 45% of a gear addendum.

7. The gear pump of claim 6, wherein the slot depth is about 33% of the gear addendum and the slot width is about 25.3% of the gear addendum.

8. The gear pump of claim 1, wherein the second distance is in a range of about 90% to about 115% of a gear addendum away from the bearing center line towards the fluid discharge at the bearing split line.

9. The gear pump of claim 8, wherein the second distance is about 103.21% of the gear addendum.

10. The gear pump of claim 1, wherein the third distance is about 63% of the gear addendum.

11. A method for pumping a fluid comprising:

providing a gear pump comprising:

a first gear having a first axis, a first gear root diameter, and a plurality of first gear teeth having a gear addendum and a gear set pressure angle;

a second gear having a second axis, a second gear root diameter, and a plurality of second gear teeth having the gear addendum and the gear set pressure angle;

a housing comprising:

a fluid inlet and a fluid discharge;

a first gear bearing and a second gear bearing configured to position the first gear and the second gear along a bearing center line extending between the first axis and the second axis on opposite sides of a bearing split line, the bearing split line extending through a midpoint between the first gear root diameter and the second gear root diameter and extending perpendicular to the bearing center line, the first gear bearing and the second gear bearing configured to position the first gear teeth and second gear teeth in intermeshing contact; and, a central fluid dam comprising:

a first face arranged at an angle to the bearing split line, spaced apart from the bearing center line at the bearing split line a first distance towards the fluid inlet, formed as a straight edge intersecting the bearing split line and extending from the first gear root diameter away from the bearing center line to the second gear root diameter;

a second face arranged approximately perpendicular to the bearing split line, spaced apart from the bearing center line at the bearing split line a second distance towards the fluid outlet, and extending between the first gear root diameter and the second gear root diameter; and a vent formed in the second face proximate the second gear, the vent having a semi-circular cross-section extending into the second face, the vent having a radius approximately tangent to the second gear root diameter, and the vent being spaced apart from the bearing center line toward the fluid discharge a third distance in a range of about 50% to about 75% of a gear addendum;

providing the fluid at the fluid inlet to a collection of tooth spaces;

driving the first gear;

driving the second gear with the first gear; and urging the movement of the fluid in the collection of tooth spaces from the fluid inlet to the fluid discharge, wherein backflow of the fluid from the fluid discharge to the fluid inlet is impeded by the central fluid dam.

12. The method of claim 11, wherein the first distance is in a range of about 35% to about 65% of a gear addendum away from the bearing center line towards the fluid inlet at the bearing split line.

13. The method of claim 12, wherein the first distance is about 47% of the gear addendum.

14. The method of claim 11, wherein the angle to the bearing split line ranges from about the angle of the gear set pressure angle plus 5 degrees to about the angle of the gear set pressure angle minus 5 degrees.

15. The method of claim 14, wherein the angle to the center line is about 25 degrees.

16. The method of claim 11, wherein the central fluid dam further comprises a slot formed in the first face proximate the first gear, the slot extending approximately tangent to the first gear root diameter toward the fluid discharge, the slot having a slot width in the range of about 15% to about 44.6% of the gear addendum, and the slot having a slot depth in the range of about 15% to about 45% of a gear addendum.

17. The method of claim 16, wherein the slot depth is about 33% of the gear addendum and the slot width is about 25.3% of the gear addendum.

18. The method of claim 11, wherein the second distance is in a range of about 90% to about 115% of a gear addendum away from the bearing center line towards the fluid discharge at the bearing split line.

19. The method of claim 18, wherein the second distance is about 103.21% of the gear addendum.

20. The method of claim 11, wherein the third distance is about 63% of the gear addendum.

* * * * *